United States Patent [19]

Clark et al.

[11] Patent Number: 4,541,947

[45] Date of Patent: Sep. 17, 1985

[54] METHOD FOR CROWD AND RIOT CONTROL

[75] Inventors: Charles J. Clark, Grand Prairie; Edward M. Bennett, Dallas, both of Tex.

[73] Assignee: Rockwood Systems Corporation, Lancaster, Tex.

[21] Appl. No.: 579,147

[22] Filed: Feb. 10, 1984

[51] Int. Cl.[3] ..... B01J 13/00

[52] U.S. Cl. ..... 252/307; 169/46; 252/3; 261/DIG. 26

[58] Field of Search ..... 252/3, 307, 359 E; 169/46; 261/DIG. 26

[56] References Cited

U.S. PATENT DOCUMENTS

| | | | |
|---|---|---|---|
| 3,186,490 | 6/1965 | Jamison et al. | 261/DIG. 26 |
| 3,578,590 | 5/1971 | Nieneker et al. | 252/3 X |
| 3,814,808 | 6/1974 | Schwendeman et al. | 252/307 X |
| 4,203,974 | 5/1980 | Brown, Jr. et al. | 252/307 X |

*Primary Examiner*—Richard D. Lovering

*Attorney, Agent, or Firm*—Beehler, Pavitt, Siegemund, Jagger & Martella

[57] ABSTRACT

An improved riot and crowd control interdiction method involves forming, in a defined location, a foam barrier which effectively inhibits passage through the barrier. Other anti-personnel devices may be placed and obscured by the foam barrier. Various barriers and methods to form a contained interdiction foam barrier are disclosed.

8 Claims, No Drawings

METHOD FOR CROWD AND RIOT CONTROL

FIELD OF THE INVENTION

The present invention relates to the control of crowds and riots and the like and more particularly to improved methods for controlling the same without the necessity of physical force, through the use of an interdiction barrier which may be quickly and easily provided and confined and controlled.

BACKGROUND OF THE INVENTION

Crowd and riot control have always been a problem for law enforcement officials, not only on a national scale but on an international scale as well. Typically, crowds and rioters have been dispersed by tear gas, water cannons, physical force and the like. The result is that law enforcement officials, even though dressed in riot gear or protective clothing, have been unable to disperse large unruly crowds, without being injured or injuring the participants.

Normally, this type of civil disorder takes place in open street areas, with the participants scattered throughout the region and tending to travel as a crowd through and along adjacent streets. The size of the group may increase as further participants join them from the surrounding streets. The ability to see and to hear what is going on in the riot area tends to be a factor in the spread and inability to exercise effective control.

In the case of prison riots, for example, rioting inmates may take control of a segment of the institution, frequently with hostages. History has proven that prison riots generally result in fatalities or serious bodily damage to the prison population or the law enforcement officials on the scene.

As is apparent, it would be desirable to provide a system which is easily transportable, easy to use, essentially harmless to people, but which functions to disorient people as they tend to travel through a barrier.

It is known in the prior art to use foams in fighting fires. Typically such foams are formed from water-soluble surfactants of the perfluorocarbon type which may be dispensed from a variety of different types of equipment, all well known in the art. One such typical material is known in the art as AFFF, see U.S. Pat. Nos. 3,258,423; 3,562,156 and 3,772,195, for example. Generically these materials are also known as FCS and HCS materials, e.g., fluorocarbon surfactants and hydrocarbon surfactants. Variations include those AFFF compositions which include a fluorochemical synergist known as F-amide and an FCS called F-AMPS, see for example U.S. Pat. Nos. 4,090,967 and 4,014,926. These foam producing materials are known to produce high-expansion foams which are known to spread over the surface in order to suppress vaporization of gasoline, which is the principal reason these materials were developed. Other patents which disclose similar materials are U.S. Pat. No. 4,090,967, United Kingdom Pat. Nos. 1,230,980 of 1971 and 1,126,027 of 1968, and Canadian Pat. No. 842,252, for example.

Foams from the above and other equivalent materials tend to be of small envelope or bubble size and flowable, the latter being one of the desirable qualities for use in fighting fires. Moreover, the foams may be formed relatively easily at the site of application by any number of different devices, all well known in the art. Portable units of various sizes as well as truck mounted units are commercially available for forming and dispensing various amounts of foamed material. For example, units are available which dispense from 2,000 to 15,000 or more cubic feet of foam per minute. Dispensing units include water reaction motors, electrically powered units, turbine units, compressed gas driven units and the like. Some of the dispensing equipment includes a tubular member which may be from two feet to ten feet in diameter, connected to the foam generator, and used to control the direction of foam discharge. The foam is discharged from the open end of the tubular member remote from the foam generator. The result is that an enormous amount of foam may be quickly dispensed from a relatively small unit in a relatively short time using a relatively small amount of water and foaming agent. Since the foam includes a surfactant, it tends to flow easily and spread quickly over the contact surfaces which it readily wets. Such foams may also be dispensed from high velocity nozzles and projected a relatively long distance and with sufficient accuracy to reach a designated target area.

Typically, the foams above described are sometimes referred to as expanded foams, having an expansion ratio of 50 to 1 to 1000 to 1. These types of foams do not have sufficient strength to remain in a three-dimensional shape, for example a mound, for any significant length of time. Where the foam is dispensed from a tubular member, customarily referred to as a chute, the chute may be of a length of one hundred feet or more, with the foam being dispensed from the open end of the chute remote from the generator. Generators are known which have an output or discharge opening which may vary from one square foot to as much as twenty-five or more square feet.

The foams described, dispensed by known equipment and techniques, tend to have a relatively long life since collapse of the foam is due principally to evaporation of the water component of the foam. Thus, in the absence of heat or flame, the foam tends to remain fairly stable for a relatively long period. However, it is also true that the foam tends to spread laterally rather quickly since this is one of the desirable features in its use as a fire-fighting material.

It is believed to be known in the prior art that fire fighting foam generating equipment may be installed on site to foam an area for the purposes of fighting fires. Even though known, there appears to have been little practical use of foams as a riot or crowd control medium apparently because of the inability to deliver the foam to the desired location and to maintain the foam in the immediate region needed for crowd and riot control. In other words, there does not exist in the prior art a methodology for containing the foam in the desired location, nor was it apparently recognized that the key to the successful use of foams as a riot control medium was dependent upon confining the foam so as to form an interdiction barrier. As near as can be determined, little use has been made in open areas, such as streets, large rooms and the like, of foams as a riot control system because it may not have been recognized that the effectiveness of the foam for that purpose could be significantly increased by confining the foam.

SUMMARY OF THE INVENTION

In accordance with the present invention, an improved crowd and riot interdiction method is provided through the use of foams heretofore used in fire fighting and wherein the formed foam is confined in such a way as to control movement, entrance or egress, into a defined area. Interdiction barriers made up of confined foam may be quickly formed of heights up to seven or eight feet and are effective as an interdiction barrier because of the psychological effect of the foam barrier and the fact that once inside the foam, there is complete disorientation.

The principal advantage of the present invention is that the interdiction barrier of foam may be easily formed, but to be successful, the foam barrier must be confined in place so that its height and location remain fixed and are visually perceptible. Various methods may be used to create the barrier, which may be of various shapes and sizes depending upon the nature of the control desired.

Where total confinement is desired, the barrier may be of a size and shape which completely surrounds the area to be interdicted. For example, if entrance into a building, or exit from a building is to be prevented, a foam barrier must be appropriately placed and retained in that location. If a street or a plurality of streets are to be interdicted, the foam barrier is placed across the street and must be confined and controlled so that the barrier remains in place.

One of the significant advantages of the present invention is that it may be practiced with equipment and materials now generally available, for example from Rockwood Systems Corporation.

In a preferred form of the present invention, the confinement barrier is formed by one or more chutes now used to dispense fire fighting foam, wherein the chutes are modified such that the delivery end is sealed. The chute may, for example, be lightweight plastic or fabric or any other suitable material capable of acting as a conduit for the foam. One or more apertures are formed along the length of the chute and may be oriented to point at different elevations, but preferably located to dispense the foam in a given, controlled direction once the chute is properly positioned, as will be described. In one form the chute is fully collapsible, i.e., it is not self-supporting, for ease of handling, storage and transporting. Other chute structures may be used, as will be described. At the site, the chute is positioned such that once inflated as will be described, the openings are pointed in the direction of the desired foam discharge. One or more chutes or lengths of chute may be used as needed to form the barrier.

One or more foam generators may be attached to the chutes and started, filling the chutes with foam and expanding the chutes to form a foam-filled containment barrier. This procedure, in effect, erects a barrier which extends in the desired direction and extends vertically above the ground. The vertical height of the barrier may vary, as will be described. Once the barrier is erected the foam from the generator or generators exits through the directional openings in the chute in the intended direction. The generator or generators are kept on until the entire defined region is filled with foam, preferably to a height at least equal to the vertical height of the foam-filled chute barrier. During the filling of the chutes some of the water associated with the foam within the chute separates and collects at the bottom of the chute, acting as a weight to keep the chute in place. Clean-up of the area afterwards is relatively simple and involves hosing the area with water to disperse or dissolve the foam.

Further details of this invention and a fuller understanding of the various ways in which it may be practiced may be better understood with reference to the following disclosure in which various forms of the invention are disclosed.

DETAILED DESCRIPTION OF THE INVENTION

In accordance with a preferred form of the invention, high-expansion foam may be used for several different, but beneficial, purposes in crowd and riot control and interdiction, provided a suitable barrier is provided to contain the foam in a defined area and in a controlled shape. As will be described, the barrier may be provided in several different ways. Still another purpose of the foam is to assist in the formation of a physical barrier which, in turn, forms a containment structure for the foam whose location and depth and position may be easily controlled.

The foam itself is a mass of uniform bubbles made from a water-detergent solution in which one part of the water-detergent solution may be expanded to from 50 to 1000 parts of expanded foam. The water-detergent solution may be of any of the materials previously mentioned and generally involves between 1% and 6% or more of detergent. The concentrate may be, for example, a synthetic base foam concentrate reinforced with protein additives and is used in the ratio of 1 to 3 parts by volume for each 100 parts of water by volume to form the foam. Other materials and other ratios may be used, as is known in the foam art. A typical material is known as JET-X, available from Rockwood Systems Corporation. Such a material, at an expansion of 600 to 1 contains about 75 gallons of water per 6,000 cubic feet of foam. These foams are also considered to be benign in the sense that full immersion for 60 minutes or so causes no harmful effects. Yet, there is a total loss of orientation when immersed in foam due to the inability to see or hear.

Foam generators are available which are capable of producing between 1,250 and 22,000 cubic feet of foam per minute. The expansion ratios of the foams used in such generators may vary from 135 to 1 to 1000 to 1, using water at a rate of between 37 gallons per minute at a pressure of 75 psi to as high as 165 gallons per minute at a pressure of about 100 psi. The weight of the generators may be as light as 10 pounds to as heavy as 350 pounds or more, and may be portable, trailer mounted or truck mounted. These commercially available units may also be helicopter transported. Various types of generators are available such as water reaction powered units, air aspirated units and the like. The generators generally require air for the formation of foam and operate best with fresh air.

One aspect of the foam and generation of foam is the fact that it tends to flow. Thus, an important aspect of this invention is the control of the foam, to prevent flow usually relied upon in fire fighting applications, and in contrast to such applications, to control the foam so a foam mound may be formed of a desired shape and size and confined within a defined location to a vertical height desired.

In a preferred form of the invention, the foam itself is used to construct the foam containment barrier at the desired location. To this end, a chute member is used and preferably arranged so as to extend across the ground in a desired direction, e.g., across a street. For example, when placed near a building or other structure such as a wall or dense bushes, the building or other structure may in fact form part of the barrier, with the chute forming the remaining portion of the barrier. The chute barrier may be of various cross-sectional shapes such as circular, square, rectangular, triangular, or the like. The chute may be fabricated of a variety of different materials such as plastic, nylon mesh or reinforced plastics, each of which is preferably foldable and relatively lightweight and flexible for easy storage, transport, handling and the like. In this form of the method of the present invention, the chute is not self-supporting in the sense that it has a defined expanded or partly collapsed shape. The chute may be fabricated such that as laid out on the ground, for example, it has an arcuate shape, e.g., it forms part of a circle.

The chute may vary in length from 25 to 100 feet or more and may be of a vertical height, when expanded, of 25 feet or more. A triangular shape has the advantage of a decreasing cross section in the vertical direction and thus the weight of foam gradually decreases in the vertical direction. This, however, is a more difficult and more expensive shape to manufacture, especially if made of plastic material. Regardless of the cross-sectional shape of the chute, it is preferred that one end be sealed closed and that there be at least one opening formed in a sidewall and so arranged that as the chute is laid out or unfolded during use, as will be described, the opening is pointed in the general direction of the region to be foamed. This opening is a foam discharge opening and the chute may have several such openings along its length, depending upon the length of the chute and its diameter. If there is more than one opening, they may be located to direct foam at different elevational angles relative to ground level. One or more chutes may be used to form the barrier and need not be of the same shapes or vertical heights.

The barrier member or members may be positioned in place in any number of different ways, depending upon the particular situation. Lanyards attached to the deflated barrier chutes may be projected across the area and used to position the chutes. The chutes may be placed by helicopters. Regardless of the technique used to position the chutes, they should be located in such a manner as to provide the desired barrier when expanded and when the area is filled with foam. It is possible for example to position one or more foam generators at various points with the chutes, in rolled up form, attached to the foam generator. As foam is generated and propelled down the chute, it unrolls and fills with foam, with the foam being dispensed in the desired direction through the foam exit apertures. The chutes may be laid out on the surface in the shape desired and at the proper distance from the region to be foamed. Thereafter, the foam generators may be attached and the chutes inflated with foam, the foam again being directed through the exit apertures.

It is also possible to use foam generators of different outputs for different purposes. For example, the chute barriers may be filled and maintained filled with generators of moderate capacity, while the region to be foamed is filled by a generator of different output. In this case, the foam may be dispensed by a large duct arranged to dispense the foam over or through a passage provided in the chute barrier. When filled, the chute barrier is moved back into position to complete the containment barrier. Once the containment barrier, kept inflated by the foam, is in place and the region to be interdicted is filled with foam, the system may be shut off except as needed to keep the chutes inflated.

The physical positioning of the barrier may vary depending upon the result to be achieved. For example, an entire region may be interdicted by placing barriers across the streets so as to isolate a defined area. Then, the barriers may be inflated with foam and the entire area sealed off by the barriers, or a significant portion thereof filled with foam. One of the useful qualities of expanded foam is the fact that any obstruction in its path tends to retard horizontal flow, which encourages vertical build-up of the foam. Thus, shrubs, curbs, parked vehicles, buildings, walls and the like all cause the laterally flowing foam to build vertically. It is readily possible in a very short time to provide a foam barrier of 100 feet in length, 30 feet wide and 10 feet deep, i.e., typically in as short a period as three minutes. Such a barrier may be fashioned by using spaced barrier elements with the foam filling the space between the barrier. In this case, one barrier may be formed by a line of vehicles and the other by chutes as described.

While the foam is benign, various agents may be added to the foam as generated. For example, coloring agents may be added to the foam to mark those who attempt to penetrate the foam barrier. Lacrymating agents may be added and may be encapsulated in the foam as generated, with the advantage that the same are maintained in a confined location. In more severe instances, concertina backed tape may be strung and covered by the contained foam barrier such that those to be interdicted are unable to see or locate the concertina, which in and of itself is an effective interdiction system. This latter system is likely to cause severe bodily damage to those attempting to penetrate the foam barrier simply because the foam completely obscures the concertina. In this latter case the vertical height need only be sufficient to cover the concertina tape, e.g., three to four feet in depth. Instead of concertina tape, conventional barbed wire may be used.

Again, dangerous anti-penetration elements buried in the foam, or positioned and then hidden by a foam barrier should only be used in severe situations where complete interdiction is necessary without concern for bodily damage. This type of barrier may be used where maximum security is needed, for example embassy buildings, secret installations, and the like. While the foam barrier will not stop a vehicle it may be used to obscure barriers which will stop vehicles, as for example in cases of sudden alert.

In accordance with the present invention, and as described, the essential feature is to provide a foam barrier which is contained in order to assure that the foam barrier remains in a fixed defined location. Thus, any number of different devices may be used to construct the physical barrier for the foam. For example, it is possible to erect foam barriers from various forms of sheet material supported by any number of different means. For example, overlapping plastic sheets may be hung from the windows of structures so as to form a barrier curtain. The foam may then be dispensed from a high capacity generator capable of generating foam at the rate of 22,000 cubic feet per minute. Buildings and automobiles or vehicles may be used as the barrier or a portion thereof, since the nature of the foam is such that it tends to build vertically whenever it encounters any form of obstruction to lateral flow. The larger generators are capable of producing an amazing volume of foam in a relatively short period of time, and the foam, in the absence of fire or heat, tends to be stable for a period of time sufficient to provide a foam barrier.

According to the present invention, the containment barrier may be formed of plastic or other material supported in a vertical position for the desired height. It may, for example, be formed by sheets supported from vertically arranged support elements, such as poles or vertically supported guide stringers. Chutes, however, are preferred because water from the foam tends to separate from the foam and settle at the base of the chute, acting as a weight. The barrier may be fixed in place to the supporting surface in order to prevent movement, if necessary. Self-supporting hollow barrier elements may be used, especially where the dimensions of the barrier member are such that the foam lacks sufficient strength to keep the barrier inflated or in place. Barrier elements of various different types may be used to form a containment barrier structure. For example, plastic sheet strung from buildings may be used to form a portion of the barrier structure, while chute barrier elements or fence type elements may constitute the remainder or a portion of the remainder of the barrier structure. A plurality of barrier closures of the same or different heights may be used. Thus, by way of example, the inner barrier structure may be of a greater height than the outer barrier, forming a lateral support element for the inner barrier. Virtually any form of structure may be used as a barrier since the nature of the foam is such that it tends to build up when it encounters an obstruction to lateral flow.

Another advantage of the present invention is that the foam inherently possesses fire extinguishing properties. Thus, fire bombs which land in the foam barrier are extinguished. Moreover, the foam does exhibit blast suppression qualities as set forth in application Ser. No. 579,145 filed of even date herewith and assigned to the same assignee.

It will become apparent from the foregoing description that a much improved method has been provided for the described purposes. To those skilled in the art of foams, and to those skilled in security, it will become apparent that various modifications may be made, based on the foregoing description, without departing from the scope of the present invention, as set forth in the appended claims.

What is claimed is:

1. A method of riot and crowd control to interdict rioters and the like comprising the steps of:

providing a barrier structure at a desired location to form an area through which passage by the rioters or crowd is to be denied, the step of providing said barrier structure including positioning at least one collapsible chute member to form at least one portion of said barrier structure, said chute member being sealed at one end thereof and including an opening at the other end thereof, generating a high expansion foam and filling said collapsible chute member by flow of said generated foam through said opening to form a foam filled chute barrier element of a predetermined height thereby providing at least one portion of the barrier structure, and directing said high expansion foam into the area on one side of said chute barrier to fill the area defined by said barrier structure with said high expansion foam to form a foamed area thereby to prevent passage through said foamed area and the foam filled chute barrier element.

2. The method as set forth in claim 1 wherein said chute member is of a predetermined geometrical cross-sectional shape.

3. The method as set forth in claim 2 wherein said chute member is circular in cross-sectional shape to form a cylindrical tubular barrier element.

4. The method as set forth in claim 2 wherein the step of providing a barrier structure includes the additional step of providing an additional barrier element to form another portion of said barrier structure.

5. The method as set forth in claim 4 wherein said additional barrier element is also a chute member which is filled with said high expansion foam.

6. The method as set forth in claim 4 wherein said additional barrier element is formed of sheet material, and wherein the step of providing said additional barrier element includes the step of supporting said sheet material in a vertical orientation.

7. The method as set forth in any one of claims 1, 2, 3 and 5 wherein said chute member includes at least one opening between the ends thereof, and wherein at least a portion of the foam used to fill the chute member flows through the opening in order to fill at least a portion of the area defined by said barrier structure.

8. The method as set forth in claim 1 wherein said barrier structure includes a plurality of chute elements arranged in spaced relation to form an enclosed area, and wherein said step of filling said chute member with foam includes filling each of said chute members with foam.

* * * * *